United States Patent [19]

Meyer

[11] 4,008,682

[45] Feb. 22, 1977

[54] ARROW PAPER TAPE DISPENSER

[76] Inventor: Robert T. Meyer, 415 St. Francis Drive, Green Bay, Wis. 54301

[22] Filed: Apr. 17, 1975

[21] Appl. No.: 568,949

[52] U.S. Cl. ..... 118/41; 118/225; 118/264

[51] Int. Cl.[2] ..... B05C 1/06

[58] Field of Search ..... 118/264, 213, 211, 225, 118/41, 42, 43; 156/521; 229/51 TS; 93/1 TS

[56] References Cited

UNITED STATES PATENTS

| | | | |
|---|---|---|---|
| 1,675,196 | 6/1928 | Uttz, Sr. | 118/41 X |
| 1,734,321 | 11/1929 | Youngblood | 118/264 X |
| 2,638,145 | 5/1953 | Havemann et al. | 118/41 X |
| 2,709,880 | 6/1955 | Jorgensen | 53/212 X |
| 3,084,665 | 4/1963 | Vogl | 118/264 X |
| 3,403,840 | 10/1968 | Mathes | 229/51 TS |

*Primary Examiner*—John P. McIntosh
*Attorney, Agent, or Firm*—Wheeler, Morsell, House & Fuller

[57] ABSTRACT

A gummed tape dispenser has a pair of V-shaped cutting blades for making successive V-shaped cuts in the ends of a length of tape drawn from the dispenser to provide arrow-shaped lengths of tape. The tape dispenser has a tape moistener whose central portion is masked to keep the central portion of the tape dry as it is drawn across the moistener so that the central portion of the tape will not stick to a surface (e.g. the flaps of a box) to which the moistened tape is glued. Thus the unglued tip of the pointed end of the tape can be subsequently grasped and the tape can be stripped away to facilitate opening of the box.

2 Claims, 5 Drawing Figures

ARROW PAPER TAPE DISPENSER

BACKGROUND OF THE INVENTION

This invention relates to gummed tape dispensers of the type that contain a moistener for moistening the gummed surface of the tape as it is drawn from the dispenser and a cutter for cutting lengths of tape. In the past, such tape dispensers have been widely employed in shipping departments for sealing cardboard boxes and other containers. This type of tape performs well in keeping boxes closed but is troublesome when it comes to opening the box flaps sealed thereby and often requires that the central portion of the tape be cut between the flaps with a sharp instrument before the flaps can be opened.

SUMMARY OF THE INVENTION

In accordance with this invention, arrow-shaped lengths of gummed tape are cut by a V-shaped cutter to provide a pointed tip on one end of the tape. The glue moistening mechanism is partitioned so that the central portion of the gummed surface is not moistened, whereby it remains unglued when the moistened tape is glued over a pair of box flaps. The unglued tip of the pointed end of the tape can subsequently be grasped and the tape can be stripped away by hand to free the flaps for opening. The shape of the tape as a whole directs the user to the tab tip. The central unmoistened portion of the tape is desirably formed by masking the central portion of a moistening brush in the tape dispenser so that moisture from the brush only reaches the side portions of the gummed surface, but a pair of rolls or other structures divided to moisten only side tape surfaces may be used.

DESCRIPTION OF THE PREFERRED EMBODIMENT

Figure 1:
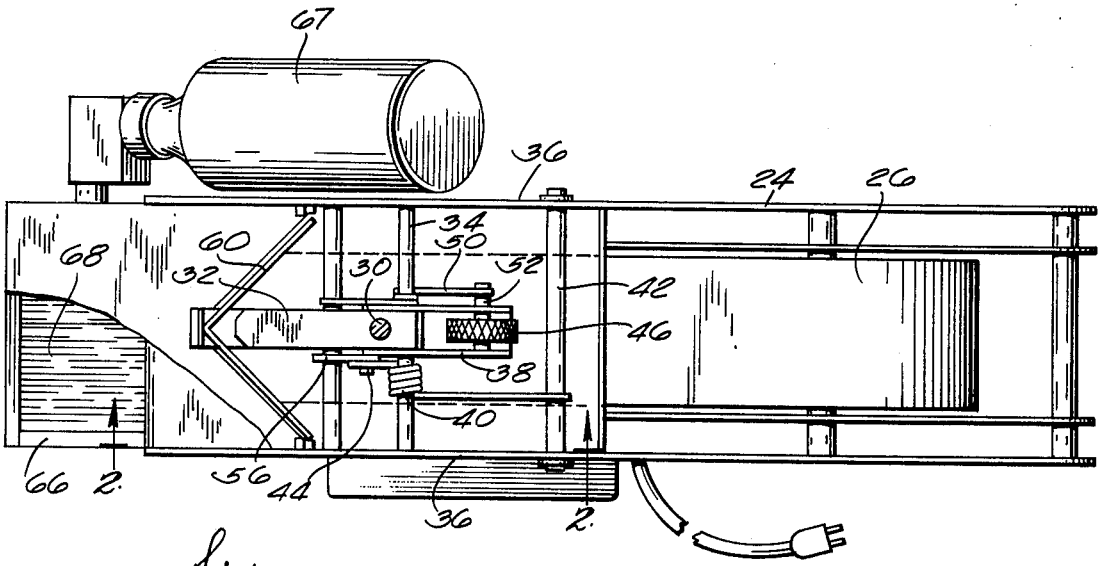
FIG. 1 is a plan view of a gummed tape dispenser utilizing one embodiment of the tape cutter and moistener of this invention.

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

The purpose of the apparatus of this invention is to produce arrow-shaped lengths of gummed tape 10 (FIG. 5) in which a central stip 12 of the gummed surface is not moistened so that it will not stick to the adjacent flaps 14 and 16 of a box 18 sealed thereby. Thus, the unglued tip 20 at the pointed end of tape 10 can be grasped and the tape can be stripped away by hand to free the flaps 14 and 16 for opening. The tape 10 is reinforced sealing tape reinforced by one or more threads 22 to prevent the tape from breaking as it is stripped away.

Figure 2:
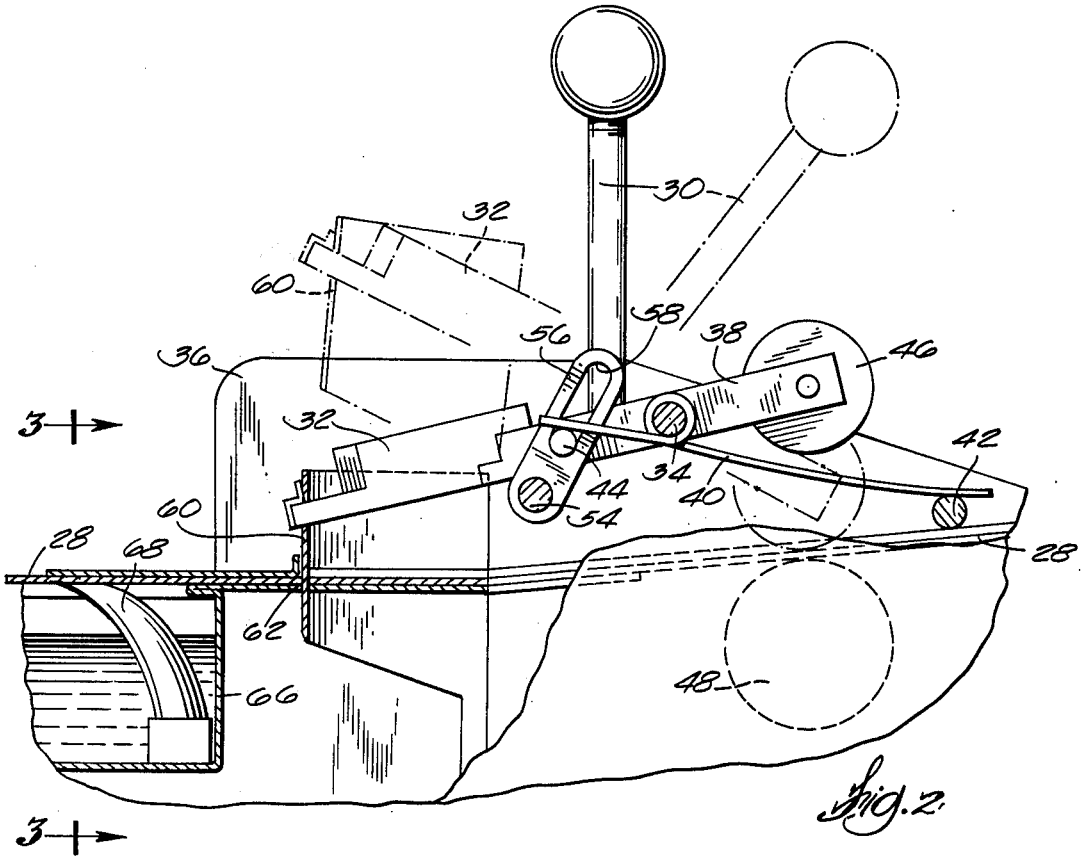
FIG. 2 is an enlarged fragmentary side elevation view taken on the line 2—2 of FIG. 1, portions of the near side wall being cut away to reveal inner details.
Figure 3:
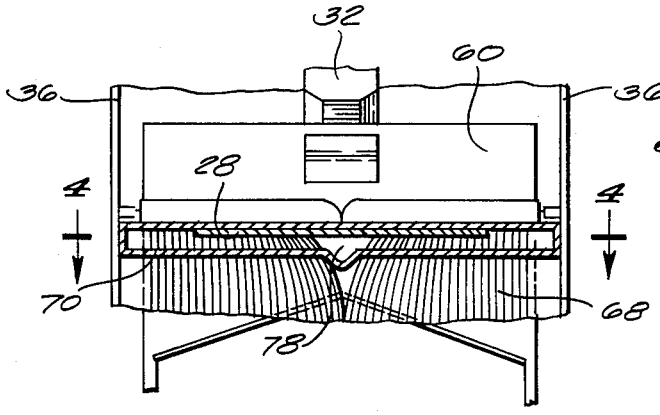
FIG. 3 is a fragmentary cross-sectional view taken on the line 3—3 of FIG. 2.
Figure 4:
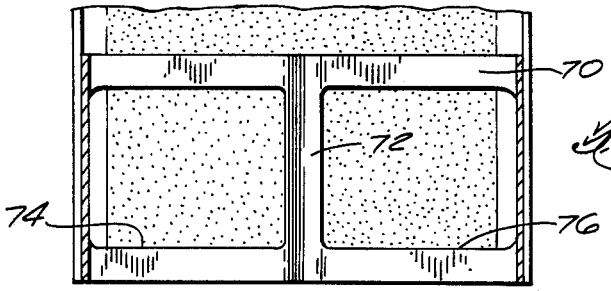
FIG. 4 is a fragmentary plan view taken on the line 4—4 of FIG. 3.

FIGS. 1–4 show one embodiment of the apparatus of this invention. Referring to FIGS. 1 and 2, this embodiment includes a housing 24 within which a roll of gummed re-inforced paper tape 26 is pivotally supported by conventional means. Paper tape 28 (FIG. 2) extends forwardly from roll 26 under a cutter and drive mechanism that includes a handle 30, a cutter arm 32 pivotally mounted on a support rod 34 that extends between opposite sides 36 of housing 24, and a drive arm 38 which is also pivotally mounted on support rod 34. Cutter arm 34 and drive arm 38 are normally spring biased toward their forward position, shown in solid lines in FIG. 2, by a torsion spring 40, which bears against a fixed rod 42 at its rear end, and bears against a pin 44 projecting from cutter arm 32 at its front end. Cutter arm 32 and drive arm 38 can be rotated to a rear position by grasping handle 30 and drawing it back to the position shown in dashed lines in FIG. 2. In this position, a freely pivoted idler roller 46 on drive arm 38 contacts the top of paper tape 28 and presses it against a driven roller 48 (FIG. 2) to cause the paper tape 28 to move out of the dispenser. Roller 48 is driven by an electric motor (not shown) which is activated by conventional switching means (not shown) when handle 30 is rotated rearwardly. When the desired length of tape has left the dispenser, the tape travel is stopped by allowing handle 30 to move forward under the impetus of spring 40, thereby lifting idler roller 46 off the top of tape 28 and deactivating the electric motor which drives driven roller 48.

Drive arm 38 is normally urged clockwise in FIG. 2 by a torsion spring 50 (FIG. 1) which engages the pivot pin 52 of roller 46 at its rear end and engages a support rod 54 at its forward end. Support rod 54 extends between the sides 36 of housing 24 and limits the forward rotation of cutter arm 32. A slotted link 56 is pivotally attached at its bottom to support rod 54 and has a slot 58 (FIG. 2) which engages pin 44 and limits the rearward rotation of handle 30, cutter arm 32, and drive arm 38. Drive arm 38 can rock counter-clockwise in FIG. 2 against the force of spring 50 (FIG. 1) to prevent excessive pressure between idler roller 46 and driven roller 48.

Figure 5:
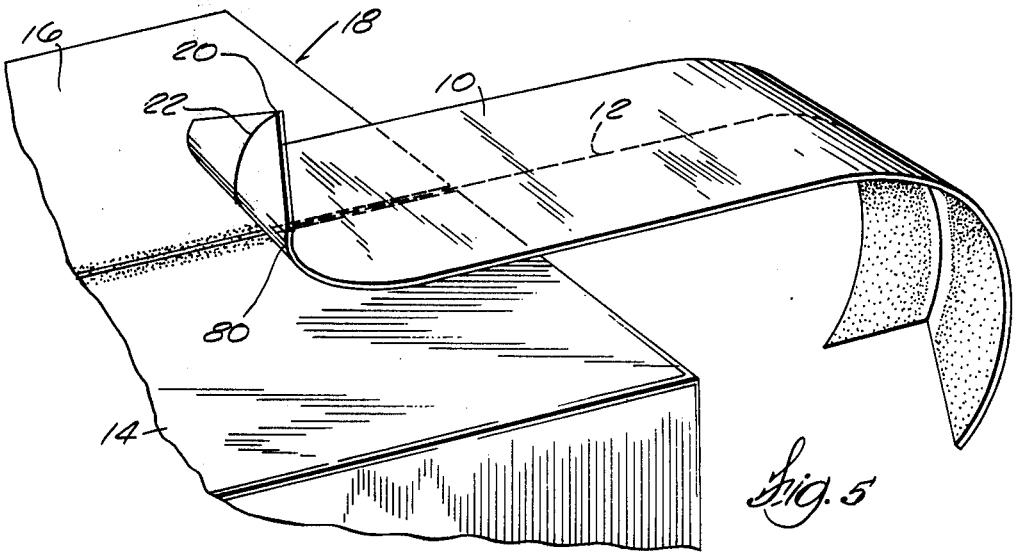
FIG. 5 is a perspective view of one end of a box being sealed by an arrow-shaped tape of this invention and illustrating how the tape can be manually stripped away to separate the box flaps so that they can be opened.

A V-shaped cutter blade 60 is attached to cutter arm 32 and is lifted above tape 28 as shown by the dashed lines in FIG. 2 when handle 30 is moved rearwardly to drive a length of tape out of the dispenser as described above. When handle 30 is moved forwardly, V-shaped cutter blade 60 moves downwardly and interacts with a second V-shaped cutter blade 62 (FIG. 2) below tape 28 to make a V-shaped cut completely across tape 28 to provide an arrow-shaped length of tape 10 such as illustrated in FIG. 5.

Immediately forward of cutter blades 60 and 62 is a moistener which comprises a water reservoir 66, a water bottle 67 mounted on the side of the dispenser by conventional means and coupled to reservoir 66 by conventional means, and a brush 68 for applying the moisture to the gummed side of paper tape 28. The upper surface of brush 68 is masked by a metal frame or mask 70 (FIGS. 3 and 4) which has a central strip 72 which covers the central portion of brush 68 and has two openings 74 and 75 (FIG. 4) on opposite sides of central strip 72 for moistening the side portions of the gummed tape 28 drawn thereover. Central strip 72 is V-shaped in cross-sectional shape (see FIG. 3) and separates the bristles of brush 68 as shown at 78 in FIG. 3 so that they do not contact the central portion of the gummed lower surface of tape 28. As a result, only the side portions of the gummed surface are moistened, the central portion remaining dry. Therefore, when tape 28 is applied to the flaps of a box, the central unmoistened portion of the gummed surface does not stick to the box flaps and can be subsequently manually stripped off starting at the free V-tip produced by the cutter, as shown in FIG. 5, to expedite opening of the box. The pointed end 80 of arrow-shaped tape 10 is important because it provides the unmoistened tip portion 20 which can be easily grasped between the thumb and finger of one hand. When stripped, the tape separates above the glue and peels away from the carton. The center unmoistened portion leaves the edge of the carton flap clean and ready to open. It is important that the V-shaped tip be dry when applied, regardless of the extent of moistening of the rest of the tape.

I claim:

1. In a tape dispenser including means for storing a supply of gummed package sealing tape, a cutting mechanism for cutting said tape, and a moistener for moistening the gummed surface of said tape as it is drawn out of said tape dispenser, the improvement comprising a pair of V-shaped cutting blades in said cutting mechanism for making successive V-shaped cuts across the entire width of said tape to produce an arrow-shaped length of tape, said moistener comprising interrupting means for moistening said gummed surface generally while leaving a dry area at the V-shaped tip so that the tip portion of said gummed surface will not stick to a surface against which it is pressed. Whereby said tape can be subsequently stripped from a carton surface to permit a box to which the tape is glued to be easily opened, said moistener comprising a moistening brush and a source of moisture therefor, and said interrupting means comprising a mask over the central portion of said brush to prevent the central portion of the gummed surface of said tape from becoming moistened, said mask including a V-shaped strip which divides said moistening brush into two spaced apart portions, said V-shaped strip being located between said brush and the gummed surface of said tape in the central portion thereof.

2. The tape dispenser of claim 1 and further comprising means including a handle for moving a length of tape out of said dispenser, a cutter arm rigidly attached to said handle and pivotally attached to said dispenser, one of said V-shaped cutting blades being coupled to said cutter arm to be actuated thereby.

* * * * *